US007168212B2

(12) United States Patent
Jette

(10) Patent No.: US 7,168,212 B2
(45) Date of Patent: Jan. 30, 2007

(54) CABLE SUPPORT APPARATUS FOR A RAISED FLOOR SYSTEM

(76) Inventor: Roger Jette, 38 W. Islip Rd., West Islip, NY (US) 11795

( * ) Notice: Subject to any disclaimer, the term of this patent is extended or adjusted under 35 U.S.C. 154(b) by 186 days.

(21) Appl. No.: 10/065,019

(22) Filed: Sep. 11, 2002

(65) Prior Publication Data

US 2002/0194801 A1 Dec. 26, 2002

Related U.S. Application Data

(63) Continuation of application No. 09/706,634, filed on Nov. 6, 2000, now Pat. No. 6,463,704.

(60) Provisional application No. 60/163,910, filed on Nov. 5, 1999.

(51) Int. Cl.
*E04C 2/52* (2006.01)

(52) U.S. Cl. ..... 52/220.5; 52/263; 211/181.1; 248/58; 248/68.1; 248/201; 248/558

(58) Field of Classification Search ..... 52/220.5, 52/220.1, 220.6, 263, 126.5, 126.6, 126.2, 52/126.7; 248/175, 58, 49, 68.1, 558, 201; 211/181.1, 184
See application file for complete search history.

(56) References Cited

U.S. PATENT DOCUMENTS 3,844,440 A 10/1974 Hadfield et al.
3,938,767 A * 2/1976 Norris ..... 248/58
4,593,499 A 6/1986 Kobayashi et al.
4,596,095 A 6/1986 Chalfant
4,612,746 A * 9/1986 Higgins ..... 52/220.5
4,630,417 A 12/1986 Collier
4,676,036 A 6/1987 Bessert
4,850,162 A 7/1989 Albrecht
5,049,700 A 9/1991 Kobayashi et al.
5,100,086 A * 3/1992 Rinderer ..... 248/49
5,384,937 A * 1/1995 Simon ..... 24/295
5,389,737 A 2/1995 Kobayashi et al.
5,412,914 A 5/1995 Daw et al.
5,477,649 A 12/1995 Bessert
5,531,410 A * 7/1996 Simon ..... 248/49
5,546,717 A * 8/1996 Penczak et al. ..... 52/220.5

(Continued)

FOREIGN PATENT DOCUMENTS

GB 2 015 268 A 9/1979

(Continued)

*Primary Examiner*—Jeanette E. Chapman
*Assistant Examiner*—Yvonne M. Horton
(74) *Attorney, Agent, or Firm*—Carter, DeLuca, Farrell & Schmidt, LLP

(57) ABSTRACT

A cable support apparatus for a raised floor system comprising at least one support member. The at least one support member is configured to be mounted to a pedestal of the raised floor system and connect with portions of cable trays. The support member, in one preferred embodiment includes a first member and a second member, each defining a slot for positioning on the support pedestal. The support member also includes a plurality of holes for the securing of the first member and the second member together as well as for connecting with cable trays. The cable trays are attached to the support member with an attachment mechanism such as a threaded stud.

33 Claims, 5 Drawing Sheets

U.S. PATENT DOCUMENTS 5,548,932 A * 8/1996 Mead ..... 52/126.6
RE35,479 E 3/1997 Witherbee et al.
5,628,157 A 5/1997 Chen
5,899,041 A * 5/1999 Durin ..... 52/660
5,953,870 A * 9/1999 Jette ..... 52/220.1
5,996,948 A * 12/1999 Skvorecz ..... 248/153
6,019,323 A * 2/2000 Jette ..... 248/49
6,023,024 A * 2/2000 Stjerneby ..... 174/95
6,061,884 A * 5/2000 Ohms et al. ..... 24/703.1
6,101,768 A 8/2000 Spingstead et al.
6,193,434 B1 * 2/2001 Durin et al. ..... 403/329
6,239,364 B1 * 5/2001 Nickel ..... 174/480
6,311,732 B1 * 11/2001 Nickel ..... 138/108
6,347,493 B1 * 2/2002 Jette ..... 52/220.1
6,401,939 B1 * 6/2002 Durin ..... 211/26
6,402,418 B1 * 6/2002 Durin et al. ..... 403/329
6,427,400 B1 * 8/2002 Greenblatt ..... 52/220.5
6,449,912 B2 * 9/2002 Jette ..... 52/220.1
6,463,704 B1 * 10/2002 Jette ..... 52/125.2
6,494,340 B1 * 12/2002 Joo ..... 220/485
6,590,154 B1 * 7/2003 Badey et al. ..... 174/480
6,672,022 B2 * 1/2004 Simmons ..... 52/263

FOREIGN PATENT DOCUMENTS

WO WO 90/10966 9/1990

* cited by examiner

CABLE SUPPORT APPARATUS FOR A RAISED FLOOR SYSTEM

CROSS REFERENCE TO RELATED APPLICATIONS

The present disclosure is a Continuation Application which claims the benefit of and priority to U.S. application Ser. No. 09/706,634, filed Nov. 6, 2000, now U.S. Pat. 6,463,704, which claims the benefit of and priority to U.S. Provisional Application No. 60/163,910, filed Nov. 5, 1999, the entire contents of each of which being incorporated herein by reference. The present disclosure is also related to applicant's prior U.S. Pat. No 5,953,870 Raised floor System and Cable Support Apparatus, filed Sep. 11, 1997, the entire contents of which are hereby incorporated by reference.

BACKGROUND OF INVENTION

1. Technical Field

The present disclosure relates to an apparatus used with a raised floor system for providing a supporting structure for a cable management system and more particularly to a cable support apparatus which can be installed on a support pedestal of the raised floor system to provide structural support for the cable management system.

2. Description of Related Art

Raised floor systems have been developed to provide the additional utility space needed in various different conduit or cable intensive environments where the original construction did not provide adequate means of accommodating the vast amount of conduit or cable. For example, probably the most common environment requiring vast amounts of additional protected space is for large computing systems. Such installations were typically made in facilities which simply were not designed to accommodate the vast amount of cable runs required to operate the typical large computer system. Other applications where additional utility space is required include mechanical systems, e.g., heating, ventilating and air conditioning systems.

A common problem experienced in utilizing raised floor systems is maintaining organization of the various cables, conduits, pipes, etc. which are routed beneath the floor system. One solution to this problem is to provide a cable tray system, cable management system, or cable pathway system beneath the floor panels of the raised floor to contain and direct cables along their respective pathways. An example of such a cable tray system is disclosed in U.S. Pat. No. 4,596,095 which issued on Jun. 24, 1986 to Chalfant (the "'095 Chalfant Patent"). The '095 Chalfant Patent features a modular cable tray assembly which is formed from modular sections which include a number of different components all of which must be separately assembled to form the cable tray. For example, the cable tray includes separate straight sections, horizontal bend sections, horizontal tee sections, horizontal cross-intersection sections, as well as splice plates to connect the various components to each other as well as supporting the assembled cable tray above the building floor. Such a cable tray assembly is, therefore, independent of the raised floor system.

One drawback of such a raised floor and cable support system is the additional labor required to assemble the various components of the separate raised floor and cable support systems. In geographic regions with particularly high labor rates, the cost of erecting such a labor intensive dual system could prove to be cost prohibitive.

Another drawback of such a system is that a manufacturer's raised floor system typically will only interrelate with and provide support for that manufacturer's cable support system. Thus, consumers are forced to retrofit or choose a less favorable system in one aspect, such as the raised floor system, over another aspect, such as the cable support system. In the alternative, independent cable support systems are procured which significantly add the overall costs because materials have to be procured for a separate independent cable support structure. These additional labor and material costs can significantly increase the overall cost of installing a complete cable support apparatus and raised floor system.

An alternative solution to supporting cable runs below a raised floor assembly is proposed in U.S. Pat. No. 5,548,932 which issued on Aug. 27, 1996 to Mead (the "'932 Mead Patent"). The '932 Mead Patent features a height adjustable cable tray support system which includes a number of separate components which must be assembled to form the cable support system. Plates which support the cable tray are secured by welding or other methods to the pedestals of the existing raised floor system featured in the '932 Mead Patent. Additionally, support rods are required in the '932 Mead Patent cable tray support system, which support the cable tray on the support plates.

One disadvantage of such a system is the labor intensive nature of the installation. In particular, each support plate must be separately secured to the floor system pedestals and the support rods and cable tray sections must be installed. This combined with the cost of the material components required for such a system can add significant cost to the installation of the complete system.

Accordingly, there is a continuing need for an improved cable support apparatus which utilizes a minimum number of components and is easier to adapt with and install on raised floor systems than existing systems. In addition, there is a continuing need for an improved cable support apparatus that can adapt to and interface with a wide variety of cable management systems.

SUMMARY OF INVENTION

A cable support apparatus for a raised floor system comprising at least one support member wherein each support member defines at least one slot for positioning on a support pedestal of a raised floor system. The support member being structurally supported by the support pedestal and the support member further defining a plurality of holes therein for the positioning and supporting of at least one cable basket. In one preferred embodiment, the at least one support member includes a first member and a second member. Each member defines a slot configured and dimensioned to engage with the pedestal of the support member and defines at least two holes for connecting with cable trays.

The presently disclosed cable support apparatus, together with attendant advantages, will be best understood by reference to the following detailed description in conjunction with the figures below.

BRIEF DESCRIPTION OF DRAWINGS

Preferred embodiments of the presently disclosed cable support apparatus are described herein with reference to the drawings, wherein.

DETAILED DESCRIPTION OF PREFERRED EMBODIMENTS

Figure 1:
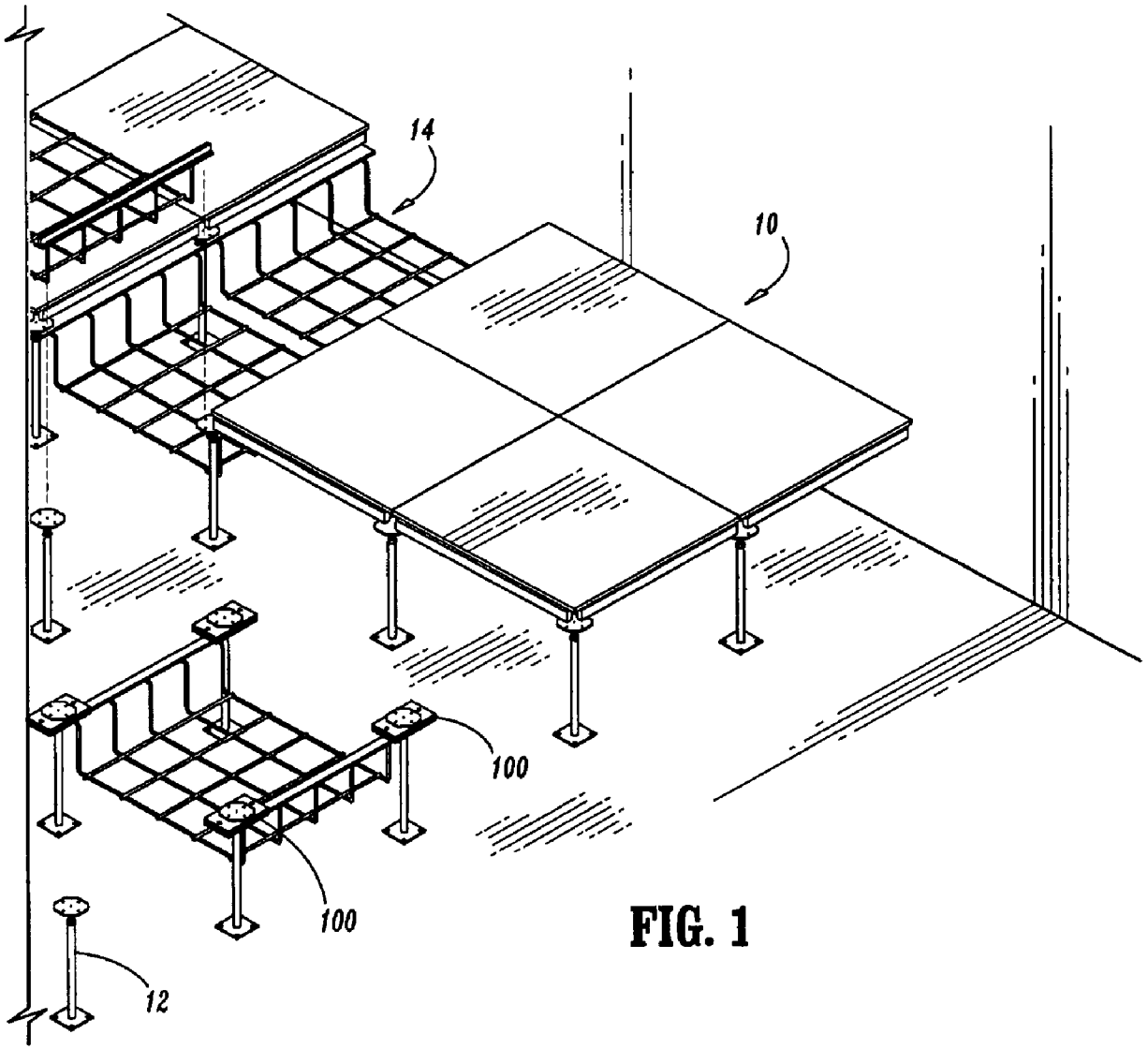
FIG. 1 is a perspective view of a cable support apparatus installed with a raised floor system and supporting portions of a cable management system.

Referring to the drawings in detail, and initially to FIG. 1, the presently disclosed cable support apparatus for a raised floor system 100 (hereinafter referred to as the "support apparatus 100") is shown installed on a plurality of support pedestals 12 of a raised floor system 10. Support apparatus 100 is positioned to provide structural support for one or more portions of a cable management system or cable supporting pathways, such as cable baskets 14.

Figure 1A:
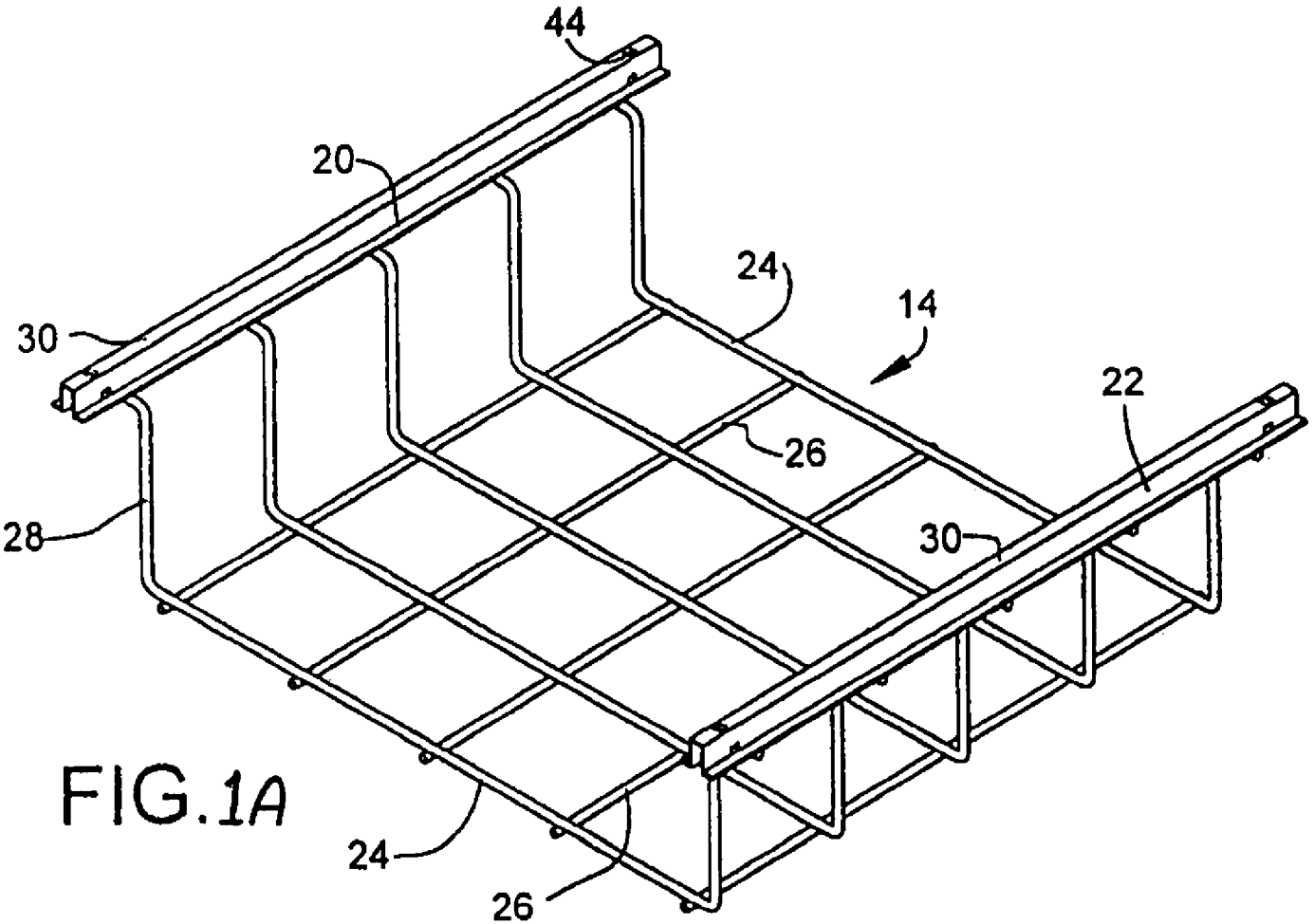
FIG. 1A is a perspective view of an illustrative cable basket for use with the cable support apparatus.

Referring now to FIG. 1A, cable basket 14 includes first and second elongated stringer elements 20 and 22, respectively. A channel section is suspended from stringers 20 and 22 so as to form a portion of a passageway for supporting cable runs thereon. In the illustrated embodiment, the channel section is formed of an open ended wire stock basket having longitudinal sections 26 attached to transverse sections 24. Transverse sections 24 include riser portions or legs 28 which are attached to the underside of stringers 20 and 22. The various elements of cable basket 14 are preferably joined by suitable known techniques, such as by welding.

Although the illustrated channel sections are formed of wire stock material, it is within the scope of the present disclosure to use other materials as well. For example, the channel section may be formed of solid or woven fabrications of various metals or any other material suitable for supporting cable runs thereon.

Figures 2A, 2B:
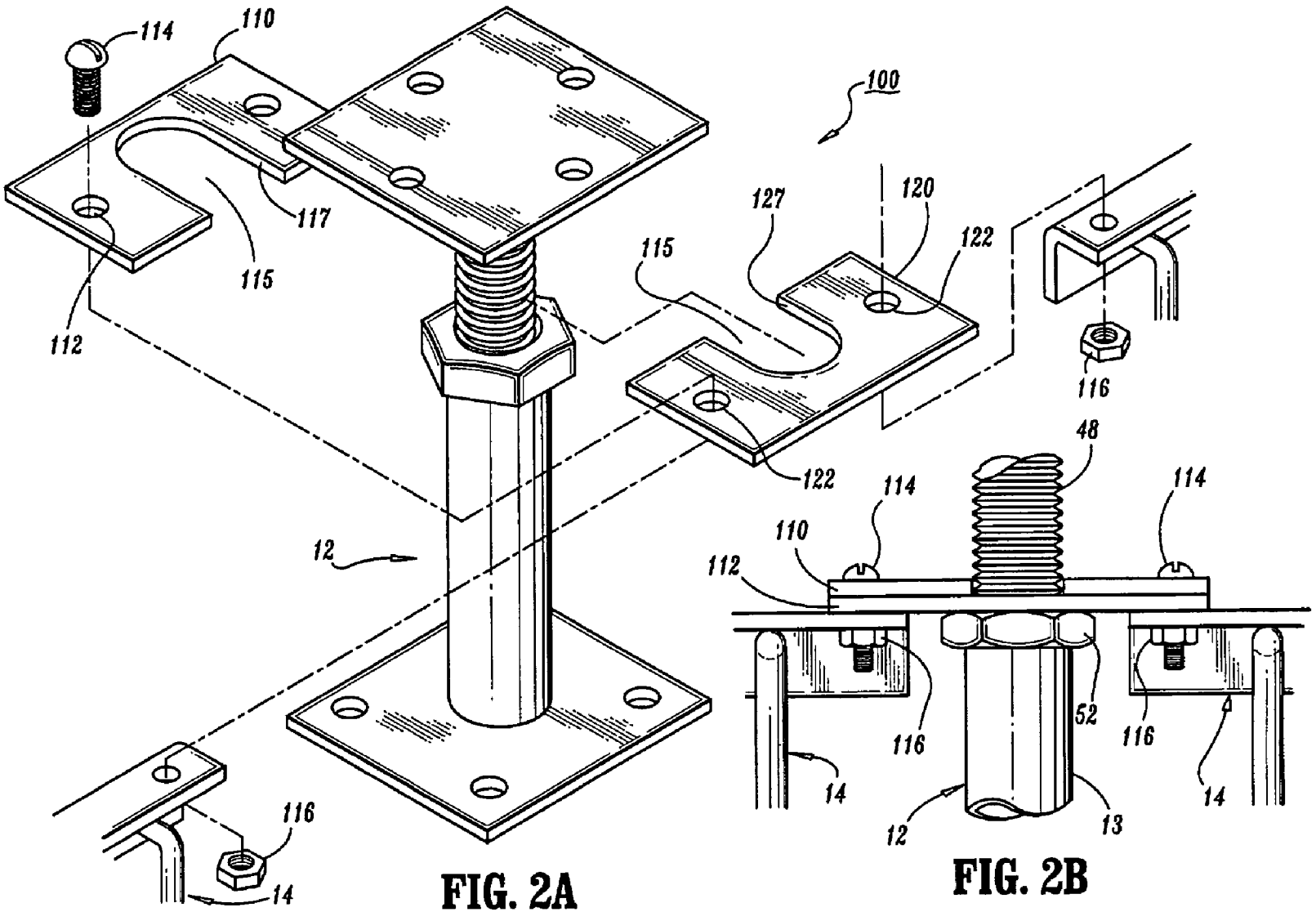
FIG. 2A is a perspective view of the cable support apparatus of FIG. 1 being installed on a support pedestal of one illustrative raised floor system.
FIG. 2B is a perspective view of the cable support apparatus of FIG. 1 installed on the support pedestal and supporting two cable baskets.

In FIG. 2A, an adapter apparatus 100 for pedestal 12 including a first member 110 and a second member 120, with each member 110 and 120 including a pair of through-holes 112 and 122 respectively and a cut-out portion 117 and 127 respectively. When first and second members 110 and 120 are joined together, through-holes 112 and 122 are concentrically aligned and cut-out portion 117 of first member 110 and cut-out portion 127 of second member 120 with support pedestal 12. The inside of hole 115 may have a lining or a bias that enhances its ability to engage support pedestal 12. Hardware common to those skilled in the art, such as threaded bolts 114 and nuts 116, are installed in through holes 112 and 122 to interlock members 110 and 120 together and against support pedestal 12.

Referring now to FIG. 2B, adapter apparatus 100 is shown installed onto support pedestal 12 and supporting two cable baskets 14. Threaded bolts 114 connect first member 110, second member 120, and cable basket 14. First member 110 and second member 120 are fabricated from common material, e.g. sheet metal stock and are fully capable of handling typical cable runs similar to that of U.S. Pat. No. 5,953,870. While adapter apparatus 100 is shown taking the form of two identical sheet metal members, it can take any geometric form, such as a bar or a pair of bars with a central capture mechanism, that interlocks around support pedestal 12 and provides through holes 112,122 for attaching cable baskets 14. Adapter apparatus 100 is preferably configured to attach to support pedestal 12 on threaded stud 48. Support apparatus 100 can be configured to rest on nut 52, or for example, provide vertical adapter through its locking mechanism with threaded stud 48 or stanchion 13.

Figure 2C:
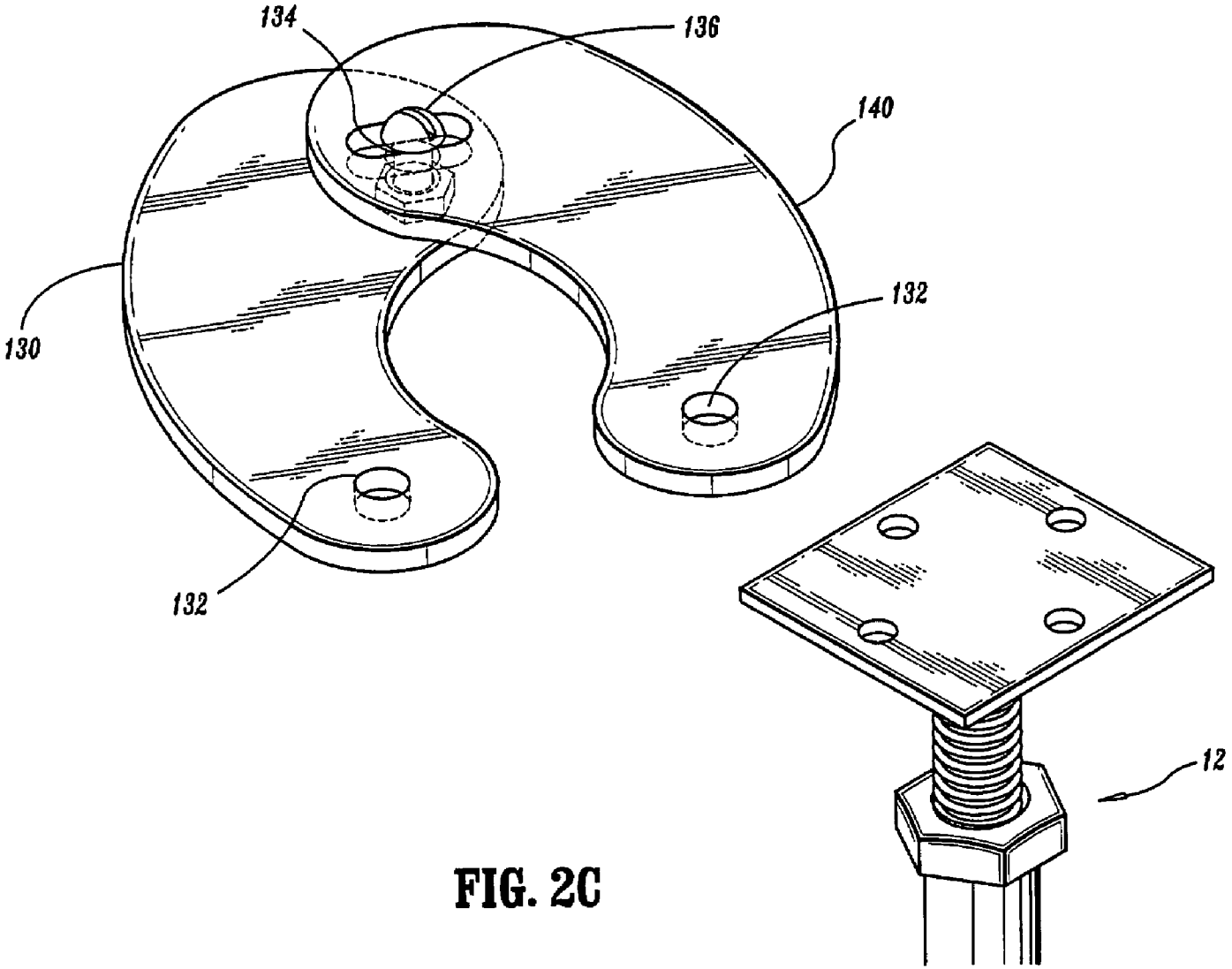
FIG. 2C is a perspective view of one alternative embodiment of the cable support apparatus of FIG. 1 being installed on the support pedestal.

In FIG. 2C, an alternative configuration of support apparatus 100 is shown with a first member 130 and a second member 140 connected together pivotally, for example, by a bolt 136 passing through a pair of coaligned slots 134 formed in an end thereof, thereby providing movement and rotation of first and second members 130 and 140 with respect to one another. In this configuration, first member 130 and second member 140 are installed around support pedestal 12 and then interlocked by coaligning through holes 132 formed near an opposite end of each member 130 and 140 and passing a bolt (not shown) therethrough.

Figure 2D:
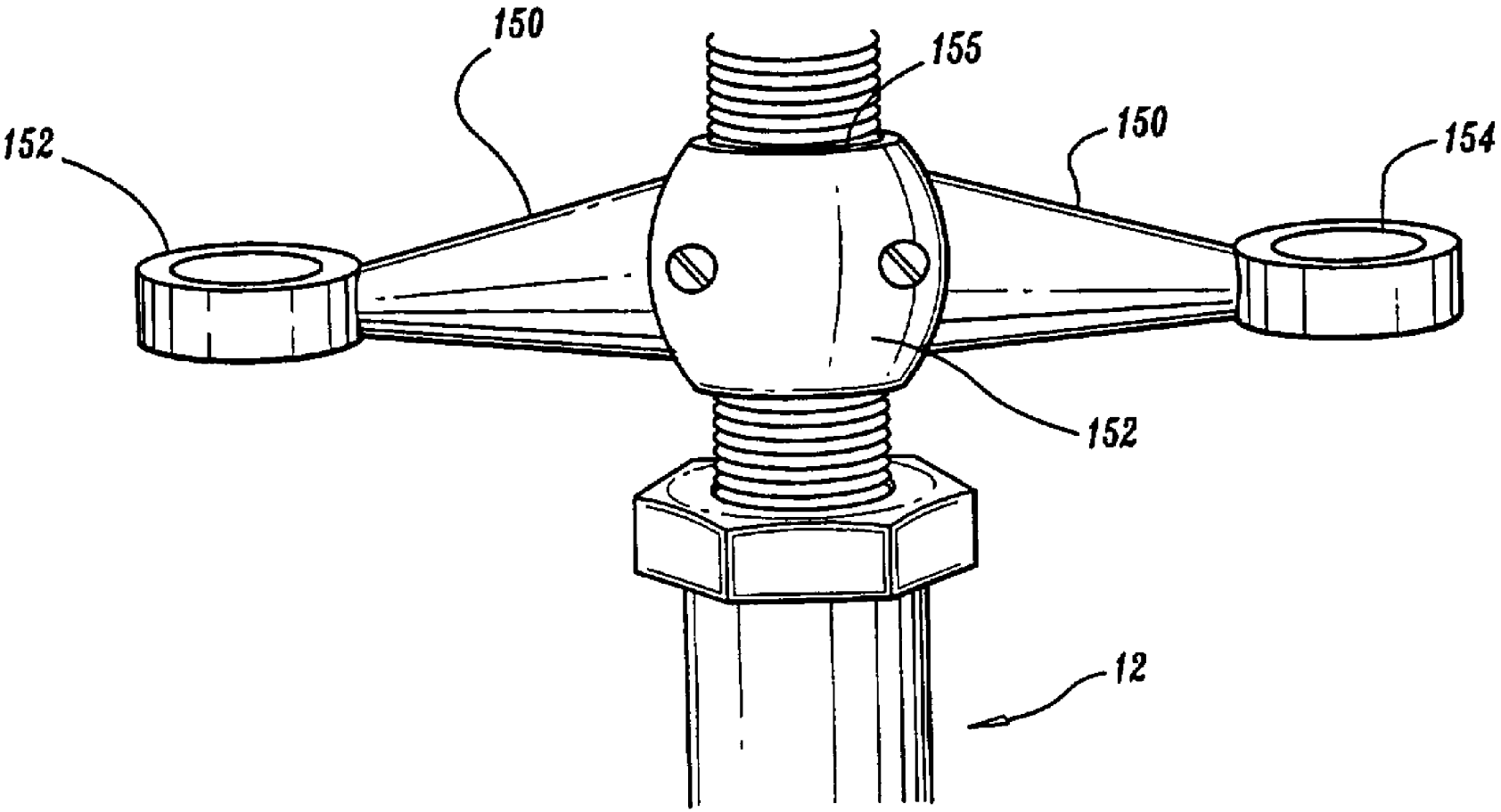
FIG. 2D is a perspective view of an additional embodiment of the cable support apparatus using an attachment mechanism at the support pedestal as constructed in accordance with the present disclosure.

Referring now to FIG. 2D, an additional alternative configuration of adapter apparatus 100 is shown with a first member 150 that forms a hole 155 that attaches to pedestal support 12 using a frictional latching or mechanical mechanism 152 that directly engages support pedestal 12. Through holes 152 and 154 are positioned to provide attachment points for cable baskets 14.

Adapter apparatus 100 is also configurable to include varying quantities of through holes or alternative attachment mechanisms that support up to four typical cable baskets 14. Additional adapter apparatus 100 configurations could, for example, support additional quantities of cable baskets 14 configurations such as crossing intersections or "T" type baskets. Alternative configurations of support apparatus 100 that adapter varying quantities of cable baskets 14 are also envisioned that include different geometric forms, pivot mechanisms, or a mechanism that captures and locks on support pedestal 12.

Although illustrative embodiments of the present disclosure have been described herein with reference to the accompanying drawings, it is to be understood that the disclosure is not limited to those precise embodiments, and that various other changes and modifications may be affected therein by one skilled in the art without departing from the scope or spirit of the disclosure. All such changes and modifications are intended to be included within the scope of the disclosure.

What is claimed is:

1. A cable support apparatus for use in a raised floor system that includes a plurality of support pedestals arranged on a base and a plurality of floor panels supported by the plurality of support pedestals a distance above the base, the cable support apparatus comprising:

at least one cable support basket being configured and adapted to support an article thereon, the at least one cable support basket including a pair of stringer elements and a plurality of transverse sections extending between the pair of stringer elements, wherein at least one transverse section is formed of wire stock; and a plurality of pedestal adapters being configured and adapted to attach one each to a respective support pedestal, wherein each of the plurality of pedestal adapters is configured and adapted to support a portion of the at least one cable support basket, wherein each cable support basket is adapted to depend at least partially from at least one of the pedestal adapters.

2. The cable support apparatus according to claim 1, wherein each cable support basket is configured and dimensioned such that upon installation in conjunction with a raised floor system, each cable support basket is disposed vertically beneath a corresponding floor panel of the raised floor system.

3. The cable support apparatus according to claim 1, wherein each stringer element is configured and adapted to be suspended from the pedestal adapters supported on the support pedestals.

4. The cable support apparatus according to claim 1, wherein each cable support basket is configured and adapted to support articles on a plane below the pair of stringer elements.

5. The cable support apparatus according to claim 1, wherein each of the plurality of transverse sections are spaced a distance from an uppermost surface of at least one of the plurality of support pedestals.

6. The cable support apparatus according to claim 1, wherein each transverse section of each cable support basket includes a pair of riser portions depending from a respective stringer element and a transverse portion extending between the distal ends of the pair of riser portions.

7. The cable support apparatus according to claim 6, wherein each cable basket includes at least one longitudinal section extending across the transverse portions.

8. The cable support apparatus according to claim 7, wherein at least one longitudinal member is formed of wire stock.

9. The cable support apparatus according to claim 7, wherein the longitudinal sections and the transverse sections define an open architecture.

10. The cable support apparatus according to claim 6, wherein each pedestal adapte supports at least an end of two adjacent stringer of two adjacemt cable support baskets.

11. The cable support apparatus according to claim 10, wherein the pedestal adapter is spaced a distance beneath an uppermost surface of at least one of the plurality of support pedestals.

12. A cable support apparatus for use in a raised floor system that includes a plurality of support pedestals arranged on a base and a plurality of floor panels supported by the plurality of support pedestals a distance above the base, the cable support apparatus comprising:

at least one cable support basket being configured and adapted to support an article thereon, the at least one cable support basket including a pair of stringer elements and a plurality of transverse sections extending between the pair of stringer elements, wherein each of the plurality of transverse sections are spaced a distance from an uppermost surface of at least one of the plurality of support pedestals; and a plurality of pedestal adapters being configured and adapted to attach one each to a respective support pedestal, wherein each of the plurality of pedestal adapters is configured and adapted to support a portion of the at least one cable support basket, wherein each cable support basket is adapted to depend at least partially from at least one of the pedestal adapters.

13. The cable support apparatus according to claim 12, wherein each cable support basket is configured and dimensioned such that upon installation in conjunction with a raised floor system, each cable support basket is disposed vertically beneath a corresponding floor panel of the raised floor system.

14. The cable support apparatus according to claim 12, wherein each stringer element is configured and adapted to be suspended from the pedestal adapters supported on the support pedestals.

15. The cable support apparatus according to claim 12, wherein each cable support basket is configured and adapted to support articles on a plane below the pair of stringer elements.

16. The cable support apparatus according to claim 12, wherein at least one transverse section is formed of wire stock.

17. The cable support apparatus according to claim 12, wherein each transverse section of each cable support basket includes a pair of riser portions depending from a respective stringer element and a transverse portion extending between the distal ends of the pair of riser portions.

18. The cable support apparatus according to claim 17, wherein each cable basket includes at least one longitudinal section extending across the transverse portions.

19. The cable support apparatus according to claim 18 wherein at least one longitudinal member is formed of wire stock.

20. The cable support apparatus according to claim 18, wherein the longitudinal sections and the transverse sections define an open architecture.

21. The cable support apparatus according to claim 17, wherein each pedestal adapter supports at least an end of two adjacent stringers of two adjacent cable support baskets.

22. The cable support apparatus according to claim 21, wherein the pedestal adapter is spaced a distance beneath an uppermost surface of at least one of the plurality of support pedestals.

23. A cable support apparatus for use in a raised floor system that includes a plurality of support pedestals arranged on a base and a plurality of floor panels supported by the plurality of support pedestals a distance above the base, the cable support apparatus comprising:

at least one cable support basket being configured and adapted to support an article thereon, the at least one cable support basket including a pair of stringer elements and a plurality of transverse sections extending between the pair of stringer elements, wherein each transverse section of each cable support basket includes a pair of riser portions depending from a respective stringer element and a transverse portion extending between the distal ends of the pair of riser portions; and a plurality of pedestal adapters being configured and adapted to attach one each to a respective support pedestal, wherein each of the plurality of pedestal adapters is configured and adapted to support a portion of the at least one cable support basket, wherein each cable support basket is adapted to depend at least partially from at least one of the pedestal adapters.

24. The cable support apparatus according to claim 23, wherein each cable support basket is configured and dimensioned such that upon installation in conjunction with a raised floor system, each cable support basket is disposed vertically beneath a corresponding floor panel of the raised floor system.

25. The cable support apparatus according to claim 23, wherein each stringer element is configured and adapted to be suspended from the pedestal adapters supported on the support pedestals.

26. The cable support apparatus according to claim 23, wherein each cable support basket is configured and adapted to support articles on a plane below the pair of stringer elements.

27. The cable support apparatus according to claim 23, wherein at least one transverse section is formed of wire stock.

28. The cable support apparatus according to claim 23, wherein each of the plurality of transverse sections are spaced a distance from an uppermost surface of at least one of the plurality of support pedestals.

29. The cable support apparatus according to claim 23, wherein each cable basket includes at least one longitudinal section extending across the transverse portions.

30. The cable support apparatus according to claim 29, wherein at least one longitudinal member is formed of wire stock.

31. The cable support apparatus according to claim 29, wherein the longitudinal sections and the transverse sections define an open architecture.

32. The cable support apparatus according to claim 23, wherein each pedestal adapter supports at least an end of two adjacent stringers of two adjacent cable support baskets.

33. The cable support apparatus according to claim 32, wherein the pedestal adapter is spaced a distance beneath an uppermost surface of at least one of the plurality of support pedestals.

* * * * *